United States Patent [19]

Lyons

[11] Patent Number: 5,040,103

[45] Date of Patent: Aug. 13, 1991

[54] LIGHT ASSEMBLY FOR WIDE AREA ILLUMINATION

[75] Inventor: Harold W. Lyons, Killingworth, Conn.

[73] Assignee: Whelen Technologies, Inc., Chester, Conn.

[21] Appl. No.: 495,859

[22] Filed: Mar. 19, 1990

[51] Int. Cl.[5] ..... F21V 5/02

[52] U.S. Cl. ..... 362/268; 362/309; 362/331; 362/339

[58] Field of Search ..... 362/61, 309, 326, 327, 362/328, 329, 331, 333, 335, 336, 339, 268

[56] References Cited

U.S. PATENT DOCUMENTS

| | | | |
|---|---|---|---|
| 2,662,165 | 12/1953 | Franch | 362/331 X |
| 4,542,448 | 9/1985 | Yamai et al. | 362/339 X |
| 4,577,260 | 3/1986 | Tysoe | 362/61 X |
| 4,652,979 | 3/1987 | Arimi | 362/331 X |
| 4,849,861 | 7/1984 | Arimi | 362/61 |

*Primary Examiner*—Stephen F. Husar
*Assistant Examiner*—Peggy Neils
*Attorney, Agent, or Firm*—Chilton, Alix & Van Kirk

[57] ABSTRACT

A light assembly for wide area illumination employs a lens insert having a pair of opposed surfaces. One surface of the insert is defined by a series of closely spaced parallel prismatic refractors for directing light incident thereon generally in a first direction. The light assembly also includes arrays of optical elements for spreading light passing through the refractors in a pair of mutually orthogonal directions.

10 Claims, 3 Drawing Sheets

LIGHT ASSEMBLY FOR WIDE AREA ILLUMINATION

BACKGROUND OF THE INVENTION (1) Field of the Invention

The present invention relates generally to lights, and more particularly to vehicular lights providing a wide angle radiation pattern for area illumination. Accordingly, the general objects of the present invention are to provide novel and improved devices of such character.

(2) Description of the Prior Art

In light systems employed on emergency vehicles, such as police cars, ambulances, fire trucks, and the like, it is frequently desirable to incorporate lights which can effectively illuminate a wide area such as the scene of an emergency situation. Area illumination lights incorporating reflectors and lenses of various styles and configurations have been incorporated into emergency vehicle light systems for a number of years. While conventional wide angle area illumination lights have proven advantageous, there are a number of drawbacks to conventional area illumination lights. Some of the prior art lights of the type to which the invention relates are relatively expensive to manufacture. Additional deficiencies of conventional prior art area illumination lights reside in the absence of effective illumination coverage and proper directional transmission of radiation from the lights.

There are a multitude of prior art light assemblies which employ reflectors and lens elements of various configurations for effectively spreading and directing the radiation generated by a light emitter to obtain a suitable radiation pattern. For example, U.S. Pat. No. 2,142,964 discloses a vehicular light having prismatic elements with flutes superposed on the prismatic elements for spreading the light from the lamp. A number of prior art light assemblies employ prismatic lens elements and flute-like or rib-like optical spreaders for obtaining various light distribution patterns. Likewise, there are a number of reflectors of various configurations which employ multiple reflecting surfaces for generally directing radiation forwardly through lens elements to achieve wide angle radiation patterns.

Copending U.S. Pat. Application Ser. No. 337,915, filed on Apr. 14, 1989, titled: "Warning Light With Quadruple Reflective Surfaces" and U.S. Pat. Application Ser. No. 312,479, filed on Feb. 21, 1989 and titled: "Light With Wide Angle Radiation Pattern", both of which are assigned to the assignee of the present invention, disclose reflector elements for wide angle warning lights which employ a pair of light sources. In addition, the vehicular lights of the copending applications may employ optical spreader elements to disperse the radiation incident on the lens to obtain the desired light distribution pattern.

SUMMARY OF THE INVENTION

Briefly stated, the invention in a preferred form is a light assembly which includes a base having at least a first socket for mounting a light source and a reflector for collimating and directing radiation emitted from the source. A multi-component lens for redirecting radiation received directly from the source and radiation reflected from the reflector is disposed forwardly of the reflector. The lens is a multi-element subassembly comprising a rear element which includes a multiplicity of prismatic refractors. The lens subassembly rear element directs light incident on a first side thereof generally in a first direction. The lens subassembly also includes optical elements which spread the directed light by the redirection thereof in two mutually orthogonal directions. A forward lens element also fractions as a protective cover for the light source and reflector and is mounted to the base. The lens cover may include a multiplicity of generally parallel optical spreader ribs which redirect light in one of the said two mutually orthogonal directions. If such spreader members are provided on the lens cover, a second multiplicity of ribs, which are oriented transversely with respect to the ribs on the cover are provided on the opposite side of the rear element from the prismatic refractors.

In a preferred embodiment, the rear lens element further defines at least one opening which is generally aligned with a corresponding light source receiving socket. Also in a preferred embodiment, the rear lens element is a generally planar substrate with front and rear surfaces. The prismatic refractors are formed on a first of these surfaces and are closely spaced to form a serrated surface. The prismatic refractors may have a generally uniform transverse width. The spreader ribs will, in such case, typically have a transverse width which is greater than the width of the prismatic refractors.

The lens cover element may include four tubular members which project rearwardly for engagement against the base. The lens rear element is provided with locating openings dimensioned for receiving the tubular structures. The lens cover element is dimensioned to closely receive the lens rear element which may be secured thereto by thermo-adhesive material.

An object of the invention is to provide a new and improved vehicular light assembly which illuminates a wide area located out of alignment with a plane, particularly a horizontal plane, which bisects the assembly.

Another object of the invention is to provide a new and improved light assembly which is relatively inexpensive to manufacture and provides a relatively wide angle radiation pattern.

A further object of the invention is to provide a new and improved vehicular light assembly which is compact and provides a high level of light intensity and a large illuminated region for the physical size of the light assembly.

Other objects and advantages of the invention will become apparent from the drawings and the specification.

DETAILED DESCRIPTION OF THE INVENTION

Figure 1:
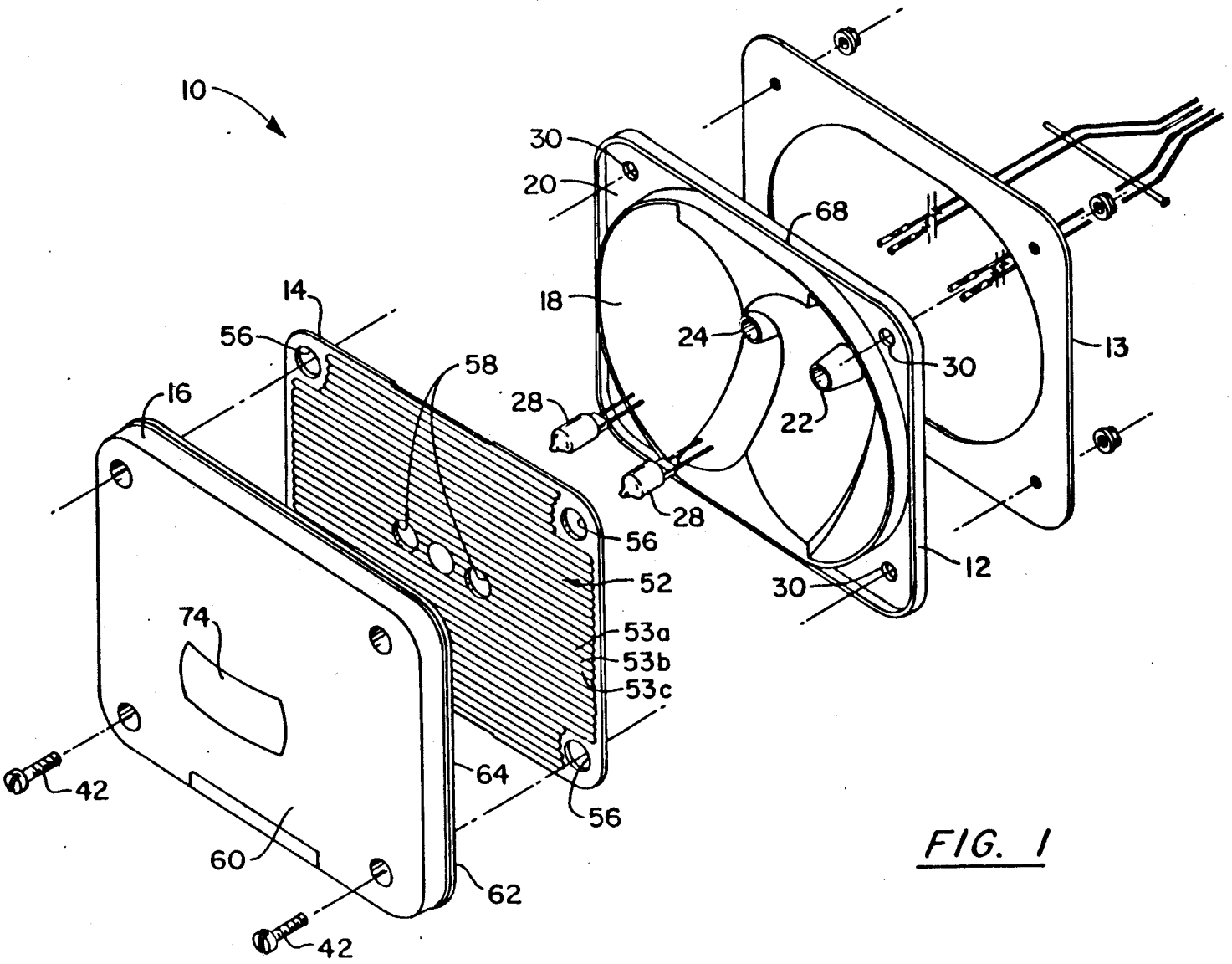
FIG. 1 is an exploded view of a light in accordance with a first embodiment of the first invention.

With reference of the drawings, wherein like numerals represent like elements throughout the FIGS., a vehicular light for remote wide area illumination, in accordance with the present invention, is generally indicated by the numeral 10. Light 10 in a preferred application is flush mounted in the body of an emergency vehicle (not illustrated). There may be a plurality of lights 10 which are arranged at a predetermined weight and spacing on the vehicle so as to provide a light emission pattern which is suitable for illuminating a wide area adjacent the vehicle such as may be required at the scene of an emergency.

Light 10 comprises a rear housing or base 12 which functions also as a reflector and the principal support structure for the light. A gasket 13 mounts at the rear of the housing 12. A lens rear element 14 and a lens cover element 16 are adapted for mounting on and securement to the front of the housing 12. The frontal silhouette of the housing 12, gasket 13, lens element 14 and lens cover 16 has a generally rounded rectangular form. Fasteners for securing the light to the vehicle, gaskets for sealing between the light assembly and the vehicle, and electrical connectors for electrically connecting the light with the vehicle electrical system are conventional and are not fully illustrated in the drawings.

The housing 12 defines a biconcave reflector 18 which partially extends forwardly from a peripheral flanged mounting panel 20 and partially protrudes rearwardly from the panel in a dual bulbous configuration. A pair of laterally spaced sockets 22 and 24, which are adapted to receive light emitters such as a lamp 28, project forwardly from the surface of reflector 18. The sockets 22 and 24 are substantially identical and, in the disclosed embodiment, have a generally cylindrical exterior shape. Each socket is associated with a parabolic reflector and the light emitter will be positioned at the focal point of the reflector by the socket. In the disclosed embodiment, each reflector is defined by two parabolic surfaces which are portions of different paraboloids of revolution having a common focal point. The reflected light generated by the light emitter in each socket is, accordingly, focused into a pair of differently directed beams. The lamp sockets 22 and 24 are adapted for mounting an incandescent lamp 28, a halogen lamp for example, or another type of light emitter as may be desired for a given application. The reflector housing 12 is a one piece member which is molded from a suitable thermoplastic material. A reflective coating is applied to the face of the housing including the reflector 18 and exterior surfaces of the socket 22 and 24 to provide an optically efficient reflecting surface. It should be appreciated that the invention is also applicable to mono-concave-type reflectors which employ only a single light emitter.

Figure 3:
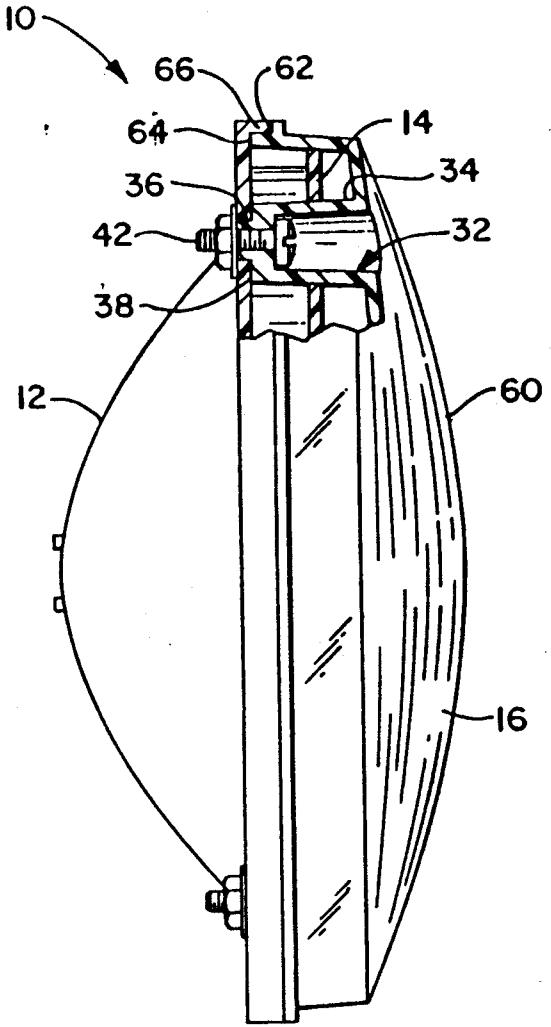
FIG. 3 is a side elevational view, partly broken away and partly in section, of the light assembly of FIG. 1.
Figure 2:
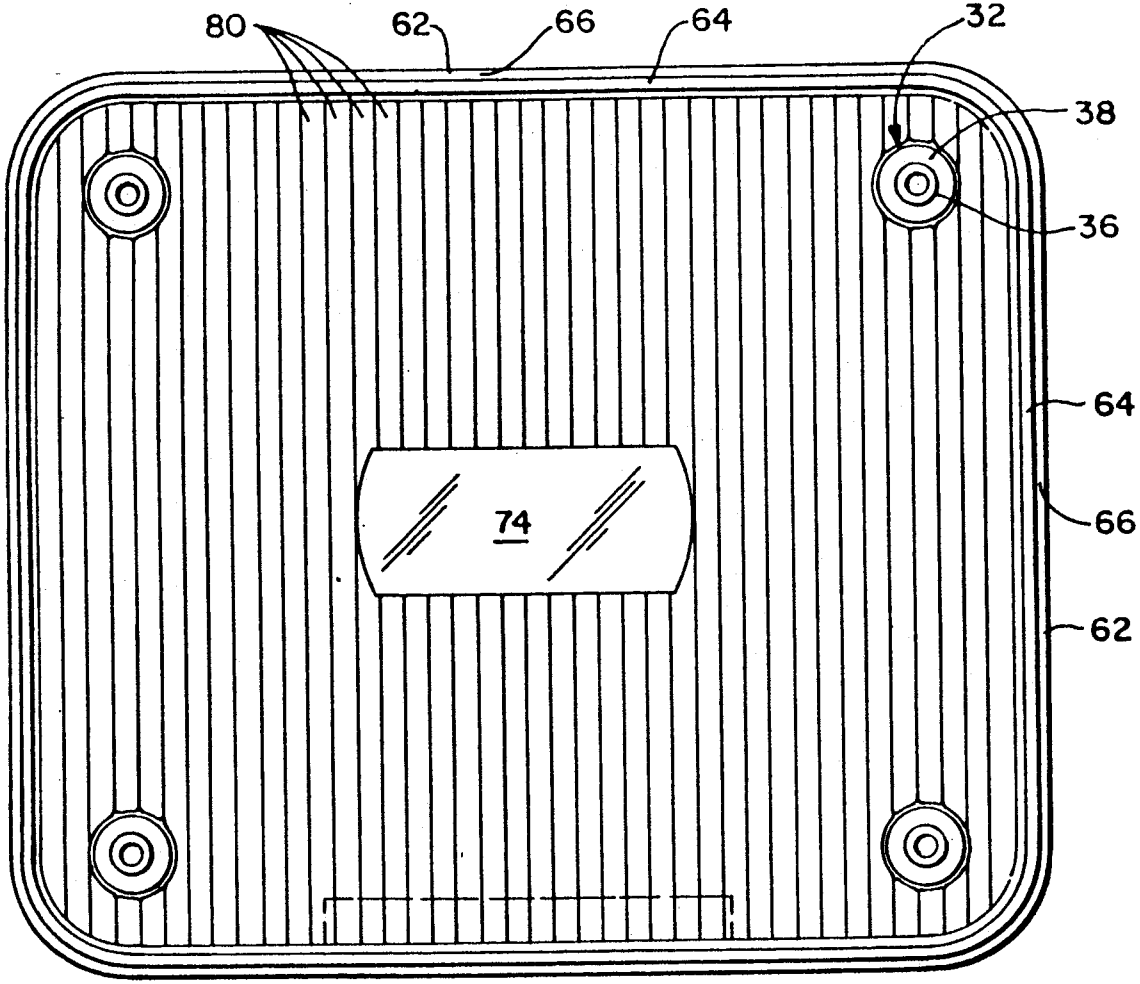
FIG. 2 is a rear view of the lens cover.

The flanged panel 20 of the reflector housing includes four orifices 30 which are disposed at corner locations. The orifices 30 are dimensioned and positioned to receive tubular projections, indicated generated at 32, which extend inwardly from the lens cover 16 as illustrated in FIG. 3. Each tubular projection 32 comprises a first enlarged diameter portion 34 and a second reduced diameter portion 36, portions 34 and 36 being interconnected by an intermediate tubular shoulder 38. Upon mounting of the rear lens element 14 and lens cover element 16, the shoulders 38 lie in flush relationship against the surface of the panel 20, and the reduced diameter portions 34 are received within the orifices 30. Each tubular projection 32, therefore, defines a bore for receiving a mounting fastener 42 which secures the lens cover element 16 to the housing 12.

The lens element 14 has four corner openings 56 which are dimensioned to closely receive the tubular projections 32 of the lens cover. In addition, the lens element 14 has two spaced shutter openings 58 which generally axially align with the lamps 28 to allow direct axial radiation from the lamps to traverse generally unimpeded through the lens element 14.

The lens cover 16 has a convex smooth face 60 and a substantially rounded rectangular shoulder 62 which is provided with a rear axially extending lip 64. The lip 64 cooperates with the shoulder 62 to define a peripheral recess 66 The recess 66 receives a complementary peripheral lip 68 provided on the flange panel 20 of the reflector housing 12 to affix the lens cover 16 and the lens element 14 onto the housing. It should be appreciated that the lens element 14 is dimensioned to be closely received by the lens cover and may be secured therewith by means of hot melt glue affixed at locations 70 illustrated in the drawings. As an alternative to the use of glue, mechanical fasteners can be employed to secure the lens element 14 to the tubular projections 32 of the lens cover.

Lens element 14 comprises a generally planar substrate having an integral rear refractive surface 50 and an integral frontal refractive surface 52. The rear refractive surface 50 comprises a multiplicity of prisms 51*a*, 51*b*, 51*c*, 51*d*..... which upon installation of the light typically extend n a horizontal orientation. The prisms 51 may have substantially the same width and dimensions and, in the horizontal orientation, are configured to direct the incident radiation radiation from the lamps 28 generally forwardly and downwardly. It will be understood that surface 50 is a Fresnel lens and the dimensions of the individual prisms can be varied to achieve the desired lighting effect. For example, the prisms may progressively change from the top to the bottom of element 14.

Figure 5:
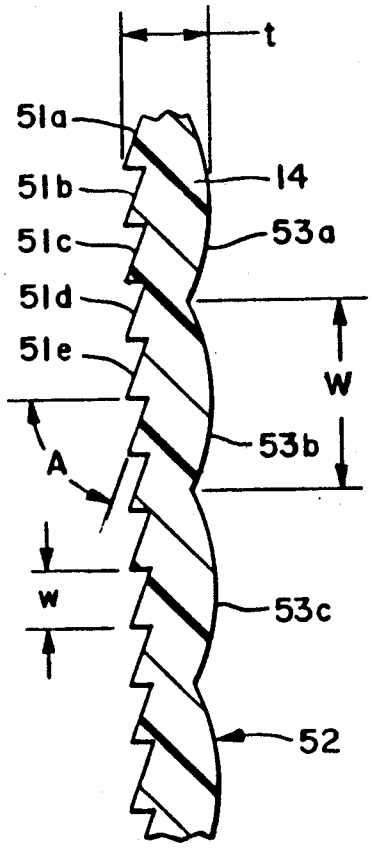
FIG. 5 is an enlarged fragmentary sectional view taken along the line 4—4 of FIG. 4.
Figure 4:
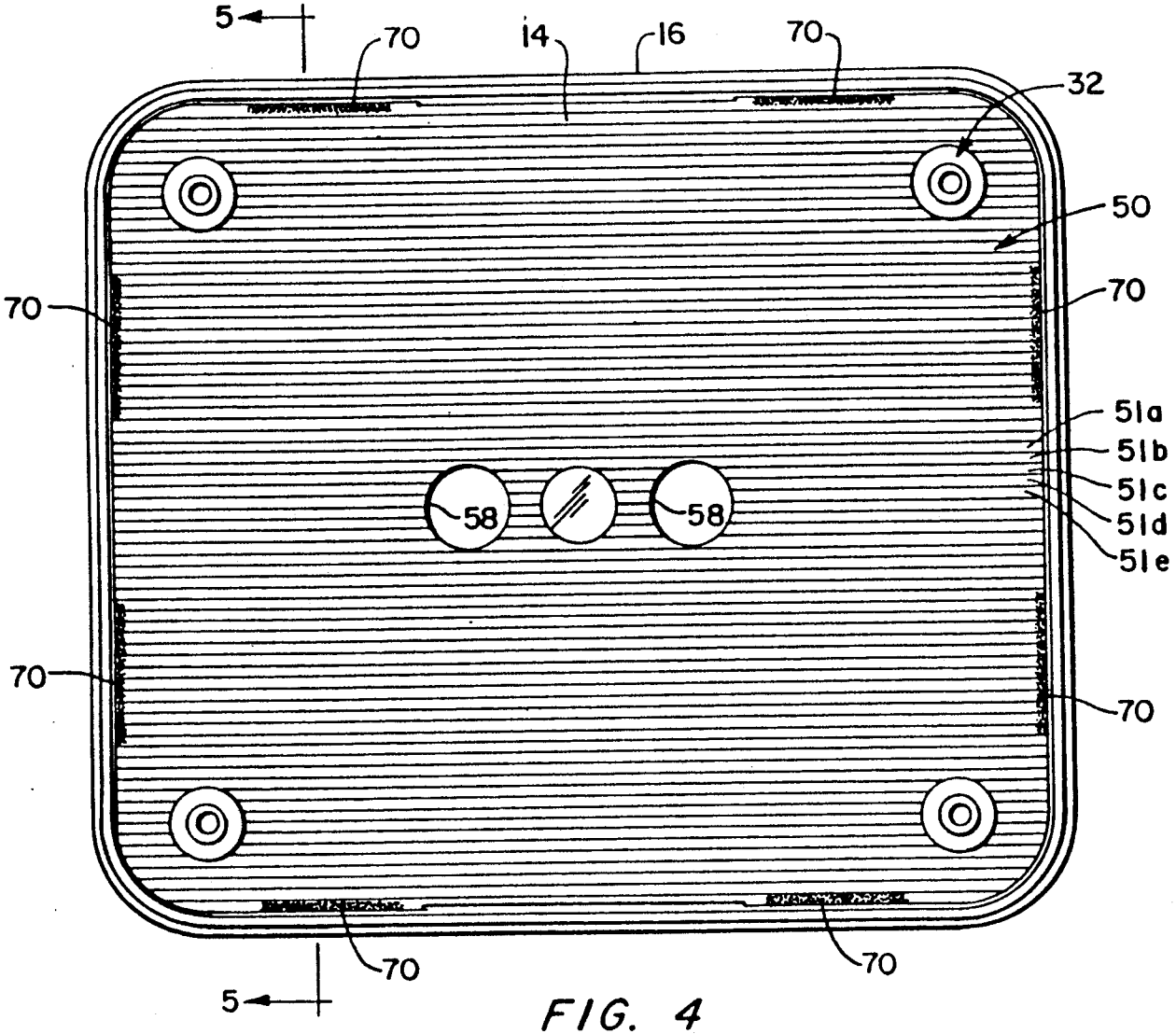
FIG. 4 is a rear view of the lens subassembly of the light of FIG. 1.

The frontal refractive surface 52 of element 14 comprises a multiplicity of parallel optical spreader ribs of flutes 53*a*, 53*b*, 53*c*.... which, in the disclosed embodiment, also extend in a horizontal orientation in generally parallel disposition to prisms 51. The widths of the spreader ribs 53 are typically substantially identical and, also typically, are significantly greater than the width of the prisms on the opposing side of the lens element 14 as best illustrated in FIG. 5. The spreader ribs function to spread the radiation over a width projecting angle about horizontal planes.

The lens cover 16 has an inner surface which faces the first lens element 14 and the reflector 18. The inner surface of cover 16 defines a multiplicity of spaced parallel optical spreader bars 80. The optical spreader bars 80 function as refractors and have arcuate projections of flute-like shape which may either be separated by narrow flat strips or may be essentially disposed in abutting side-by-side relationship The optical spreader ribs 80 of the lens cover are oriented in a generally vertical disposition which is substantially orthogonal to the disposition of the optical spreader ribs 53 and the prisms 54 of the rear lens element 14. The optical spreader ribs 80 function to distribute the incident radiation transmitted from the lens element 14 across a wide horizontal angle.

The central portion of the lens cover 16 may be provided with a substantially planar window 74, i.e., the optical spreader elements 80 may be discontinuous in a central region of lens cover element 16. The window 74 functions to allow direct radiation from the lamps 28 to pass with minimum loss in the axial direction generally orthogonal to prisms 51, optical ribs 53 and optical ribs 80.

With reference to the dimensional relationships of FIG. 5, in one example of light assembly 10 in accordance with the present invention the maximum thickness t of lens element 14 is on the order of 0.080in.; the transverse widths W of the prisms 51 are on the order of 0.064in.; the transverse widths W of the optical ribs 53 are on the order of 0.206in.; and the adjacent prisms 51 intersect at an angle A on the order or 70°.

It will be appreciated that when lens element 14 and lens cover 16 are mounted to the base as described, radiation projected from the light will be directed downwardly and will be distributed across a relatively wide angle in both the horizontal and vertical directions. Thus, when the light is mounted at a high location in the side of an ambulance, a large area of the ground adjacent the vehicle will be highly illuminated. It should be understood that the spreader ribs 53 and 80 can be reversed. Also, the spreader elements can be in the form of plural discrete "bubble" lenses on the surface 52 of element 14 opposite to the refractive prisms.

While a preferred embodiment of the foregoing invention has been set forth for purposes of illustration, the foregoing description should not be deemed a limitation of the invention herein. Accordingly, various modifications, adaptations and alternatives may occur to one skilled in the are without departing from the spirit and the scope of the present invention.

What is claimed is:

1. A light assembly comprising:

base means for supporting at least a first socket for mounting a light emitter, said base means also defining at least a first parabolic reflective surface;

a first generally planar lens element disposed forwardly of said reflective surface and socket, said first lens element having first and second oppositely facing surfaces, said first surface facing said base means reflective surface and having an array of substantially parallel prismatic refractors formed therein, said refractors having axes which extend in a first direction for redirecting light incident on said first lens element generally in a first direction, said first lens element generally in a first direction, said first lens element further including a first array of substantially parallel optical spreader members extending from said second surface, said optical spreader members of said first array having axes which are generally parallely oriented relative to the axes of said prismatic refractors for spreading light redirected by said refractors about parallel first planes; and a lens cover mounted to said base means, said first lens element being positioned between said lens cover and said base means whereby said lens cover and base means envelope said first lens element, said lens cover comprising a second array of substantially parallel optical spreader members which face and are spaced from said first lens element, the optical spreader members of said second array having axes which extend in a second direction which is different from said first direction.

2. The light assembly of claim 1 wherein said prismatic refractors and the spreader members of said first array have generally uniform widths, and the uniform width of the said spreader members is greater than the uniform width of the prismatic refractors.

3. The light assembly of claim 1 wherein said first and second directions are generally transverse.

4. The light assembly of claim 2 wherein said first and second directions are generally transverse.

5. The light assembly of claim 1 wherein said first lens element further includes a portion which passes light without redirection thereof, said portion being positioned in registration with said first socket, said portion interrupting at least some of some refractors and optical spreader members of said first array; and wherein said lens cover further comprises a window in registration with said first lens element portion, optical spreaders of said second array terminating at a pair of opposite sides of said window whereby light passing through said portion of said first lens element will pass through said window without redirection.

6. The light assembly of claim 2 wherein said first lens element further includes a portion which passes light without redirection thereof, said portion being positioned in registration with said first socket, said portion interrupting at least some of some refractors and optical spreader members of said first array, and wherein said lens cover further comprises a window in registration with said first lens element portion, optical spreaders of said second array terminating at a pair of opposite sides of said window whereby light passing through said portion of said first lens element will pass through said window without redirection.

7. The light assembly of claim 4 wherein said first lens element further includes a portion which passes light without redirection thereof, said portion being positioned in registration with said first socket, said portion interrupting at least some of said refractors and optical spreader members of said first array, and wherein said lens cover further comprises a window in registration with said first lens element portion, optical spreaders of said second array terminating at a pair of opposite sides of said window whereby light passing through said portion of said first lens element will pass through said window without redirection.

8. The light assembly of claim 1 wherein said first lens element is of generally rectangular shape and is provided with openings juxtapositioned to the four corners thereof, and wherein said lens cover comprises a plurality of projections positioned to be engaged by said lens element openings whereby said lens element may be located and secured relative to said lens cover.

9. The light assembly of claim 2 wherein said first lens element is of generally rectangular shape and is provided with openings juxtapositioned to the four corners thereof, and wherein said lens cover comprises a plurality of projections positioned to be engaged by said lens element openings whereby said lens element may be located and secured relative to said lens cover.

10. The light assembly of claim 7 wherein said first lens element is of generally rectangular shape and is provided with openings juxtapositioned to the four corners thereof, and wherein said lens cover comprises a plurality of projections positioned to be engaged by said lens element openings whereby said lens element may be located and secured relative to said lens cover.

* * * * *